US006093877A

United States Patent [19]

Nickel

[11] Patent Number: 6,093,877

[45] Date of Patent: Jul. 25, 2000

[54] SNARE DRUM STRAINER WITH QUICK RELEASE MECHANISM

[76] Inventor: Gregory L. Nickel, 3206 William Ave., N. Vancouver, BC, Canada, V7K 2Y1

[21] Appl. No.: 09/302,308

[22] Filed: Apr. 30, 1999

[51] Int. Cl.[7] ..... G10D 13/02

[52] U.S. Cl. ..... 84/415; 84/411 R; 84/413

[58] Field of Search ..... 84/411 R, 413, 84/415

[56] References Cited

U.S. PATENT DOCUMENTS

| | | | |
|---|---|---|---|
| 1,104,373 | 7/1914 | Meyer | 84/415 |
| 2,024,937 | 12/1935 | Ludwig | 84/415 |
| 2,096,209 | 10/1937 | Strupe | 84/415 |
| 2,430,184 | 11/1947 | Peacock | 84/411 R |
| 2,621,554 | 12/1952 | Way | 84/415 |
| 3,113,481 | 12/1963 | Thompson | 84/415 |
| 3,865,003 | 2/1975 | Della-Porta | 84/411 R |
| 3,981,220 | 9/1976 | Clark | 84/415 |
| 4,339,982 | 7/1982 | Hoshino | 84/415 |
| 5,107,742 | 4/1992 | Cummings et al. | 84/415 |
| 5,353,674 | 10/1994 | Volpp | 84/411 R |
| 5,410,938 | 5/1995 | Kurosaki et al. | 84/94 |
| 5,557,053 | 9/1996 | Nickel | 84/415 |
| 5,559,296 | 9/1996 | Yamashita | 84/415 |
| 5,616,875 | 4/1997 | Lombardi | 84/415 |
| 5,684,257 | 11/1997 | Yanagisawa | 84/415 |
| 5,844,157 | 12/1998 | Kasha | 84/415 |

*Primary Examiner*—Stanley J. Witkowski
*Assistant Examiner*—Kim Lockett
*Attorney, Agent, or Firm*—McEachran, Jambor, Keating, Bock & Kurtz

[57] ABSTRACT

A snare strainer for a drum. The snare strainer includes a tube having a noncylindrical transverse cross section with a first axis and a second axis with oppositely located curved bearing surfaces positioned on the first axis. A piston is positioned in the tube for slidable movement between a first position in which the snares are located against the drumhead and a second position in which the snares are located away from the drumhead. The piston has a transverse cross section similar in shape to the transverse cross section of the tube. A quick release mechanism is provided to move the piston between the first and second positions. A handle forming part of the quick release mechanism is mounted on the tube and has a linkage connecting the piston, the handle and axis of the two during movement of the piston between the first and second positions. An axial passage is formed in one of the fasteners connecting the tube to the drum to allow air flow into and out of the drum. A hanger is provided to support a snare tensioning strap where it passes through an opening in the drum rim during throw off of the snares.

7 Claims, 9 Drawing Sheets

SNARE DRUM STRAINER WITH QUICK RELEASE MECHANISM

BACKGROUND AND SUMMARY OF THE INVENTION

This invention is directed to an improved snare strainer for a drum which is more compact than previous snare strainers and more readily adaptable to drums of various sizes and in which the moving parts are closely fitted yet slide quietly without binding or twisting through a greater throw distance.

An object of this invention is a snare strainer having a sliding piston of noncylindrical cross section having at least one curved bearing surface of substantial extent.

Another object of this invention is a snare strainer having a sliding piston of non-cylindrical cross section with oppositely spaced curved bearing surfaces for smooth movement which prevents undesirable twisting of the piston during actuation.

Another object of this invention is a snare strainer having a sliding piston connected by a linkage to an operating lever in which the piston cannot be twisted during movement of the operating lever because of the non-circular transverse cross section of the piston and the complementary transverse cross section of the bore of the tube in which the piston travels.

Another object of this invention is a snare clamp stem for a snare strainer having a transverse cross section of the same non-circular shape as the bore of the piston in which it is received to prevent undesirable twisting of the stem relative to the piston during adjustment of the snares.

Another object of this invention is a snare strainer having an undercarriage which supports and guides the snare strap through the rim of the drum during throw off of the snares.

Still another object of this invention is a mounting bolt for the snare strainer which incorporates a hidden vent hole for the drum allowing better resonation of the drum without detracting from the aesthetic appearance of the drum.

Other objects of the invention may be found in the following specification, claims and drawings.

DESCRIPTION OF THE PREFERRED EMBODIMENT

The invention is illustrated more or less diagrammatically in the following drawings wherein.

DESCRIPTION OF THE PREFERRED EMBODIMENT

Figure 1:
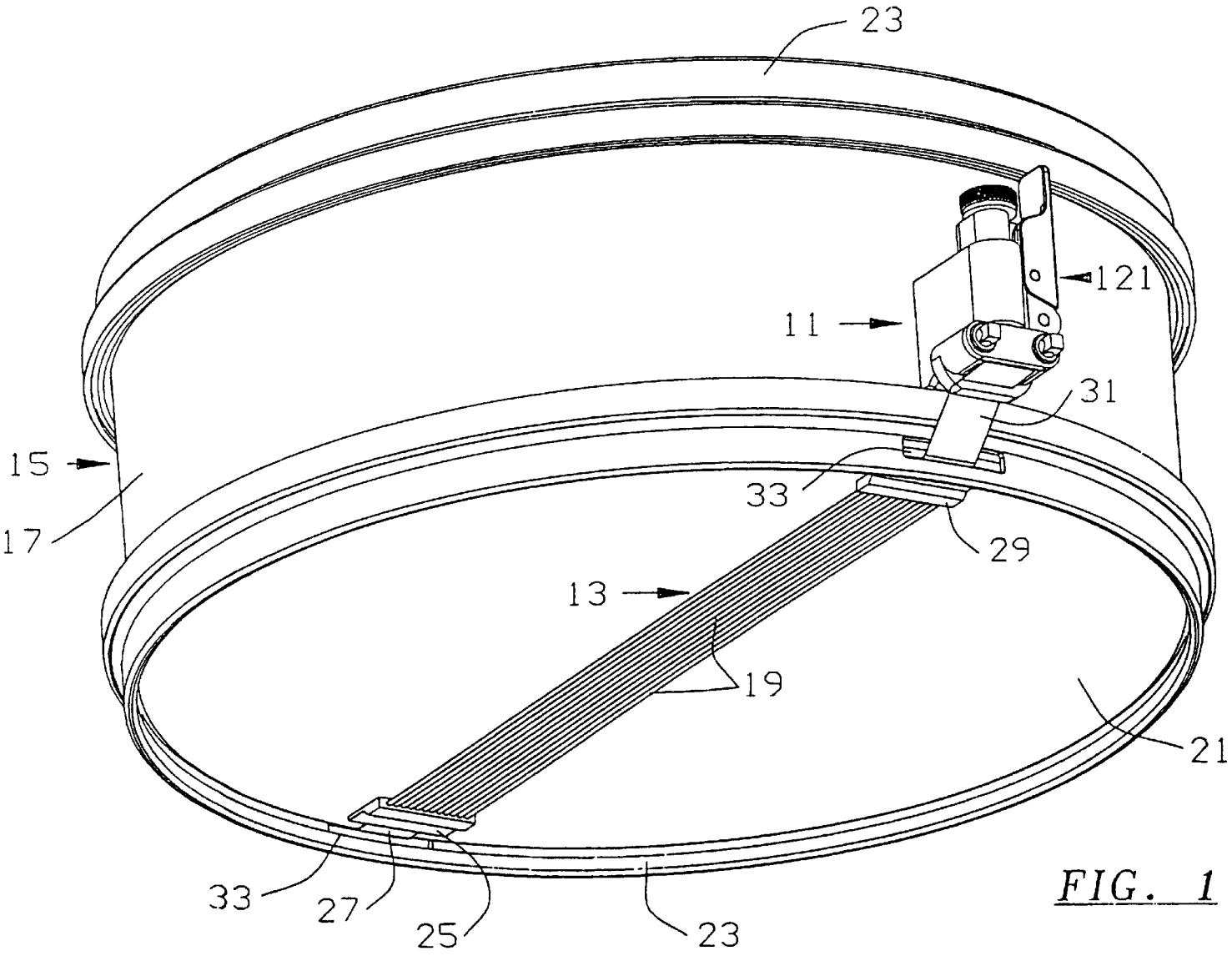
FIG. 1 is a bottom perspective view of a drum on which is mounted a snare strainer of this invention.
Figure 2:
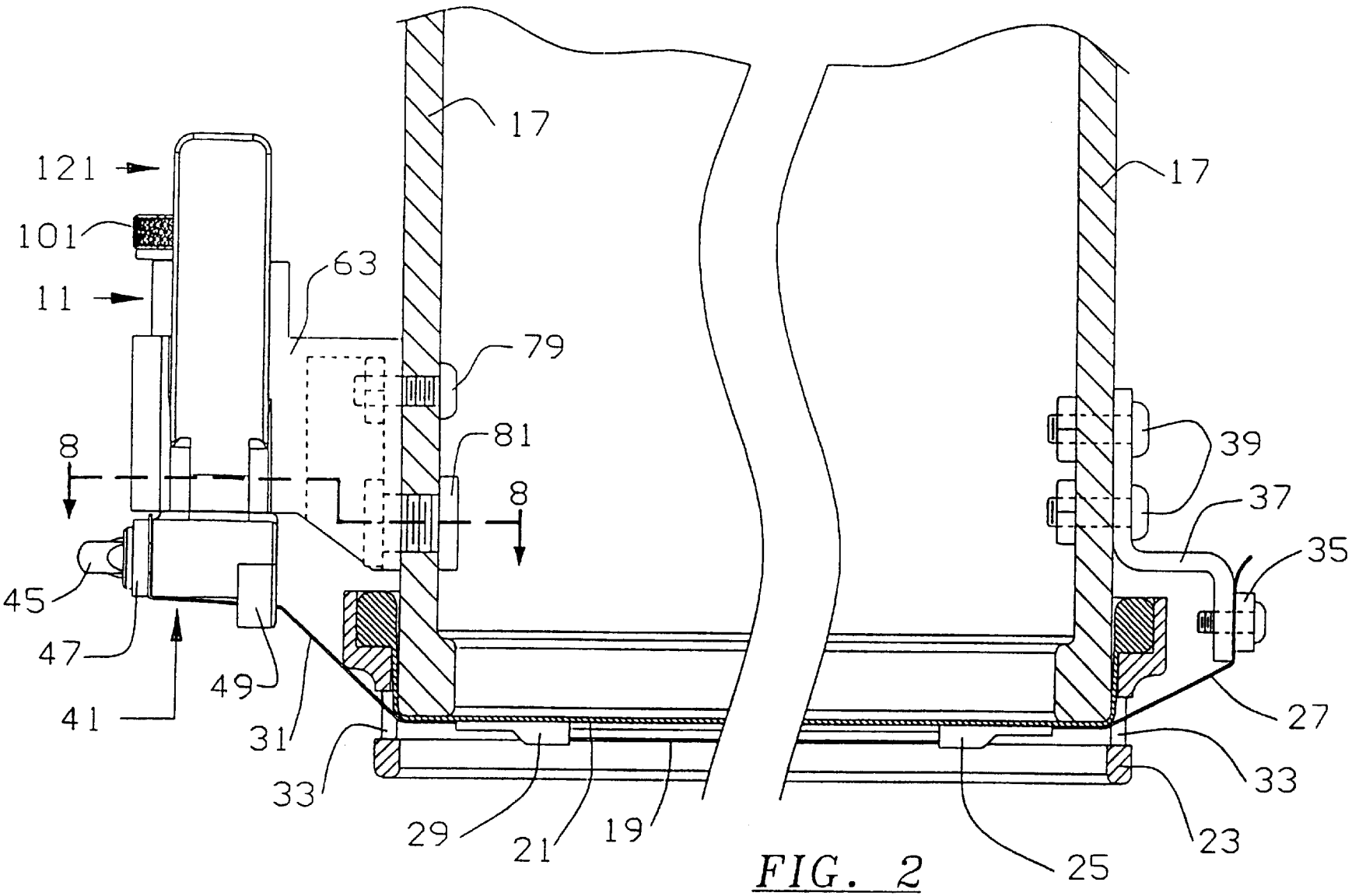
FIG. 2 is an enlarged, partial, broken, cross sectional view of a shell of a drum on which is mounted the snare strainer of this invention.
Figure 3:
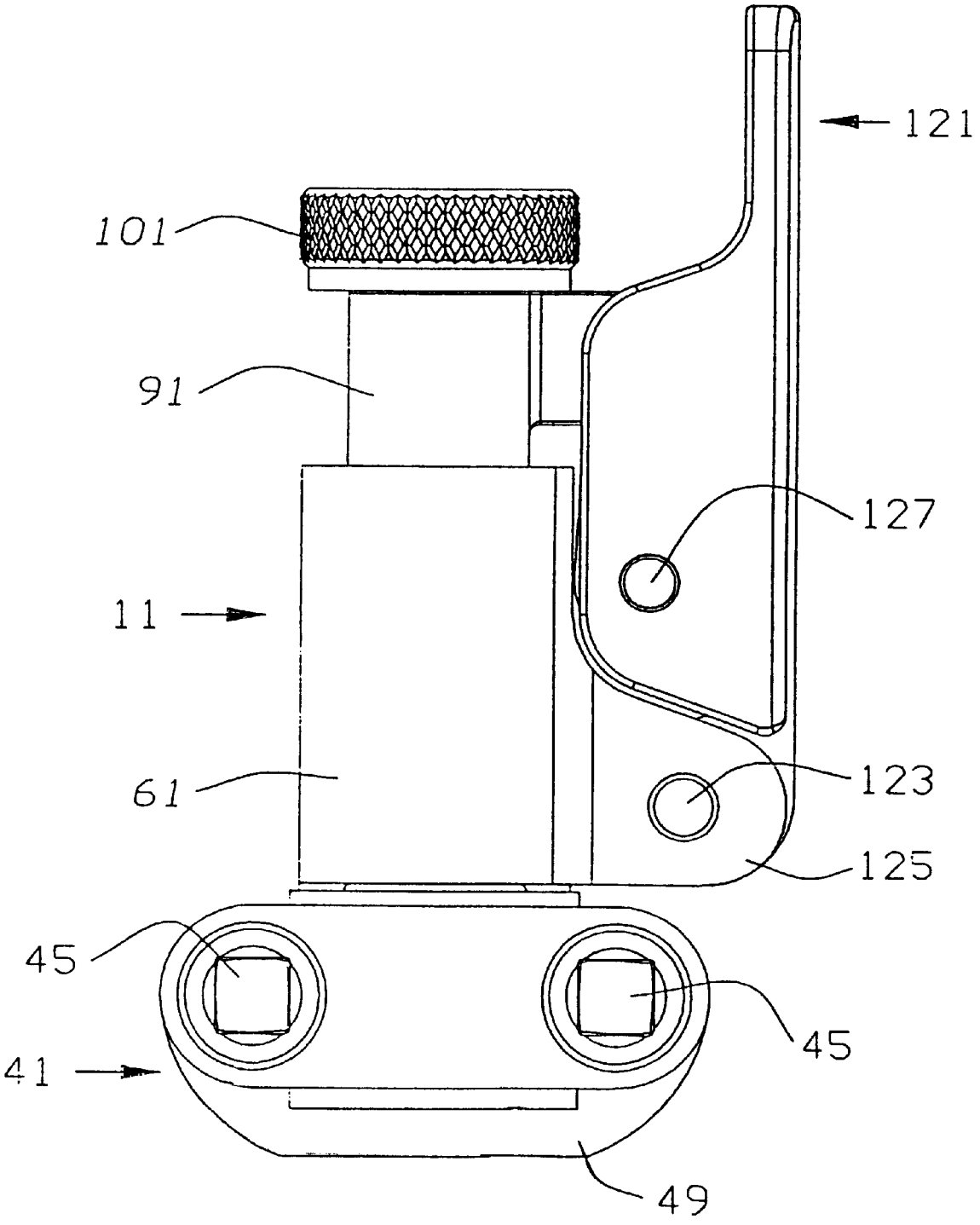
FIG. 3 is a front elevational view of the snare strainer of this invention in its snare tension applying position.
Figure 4:
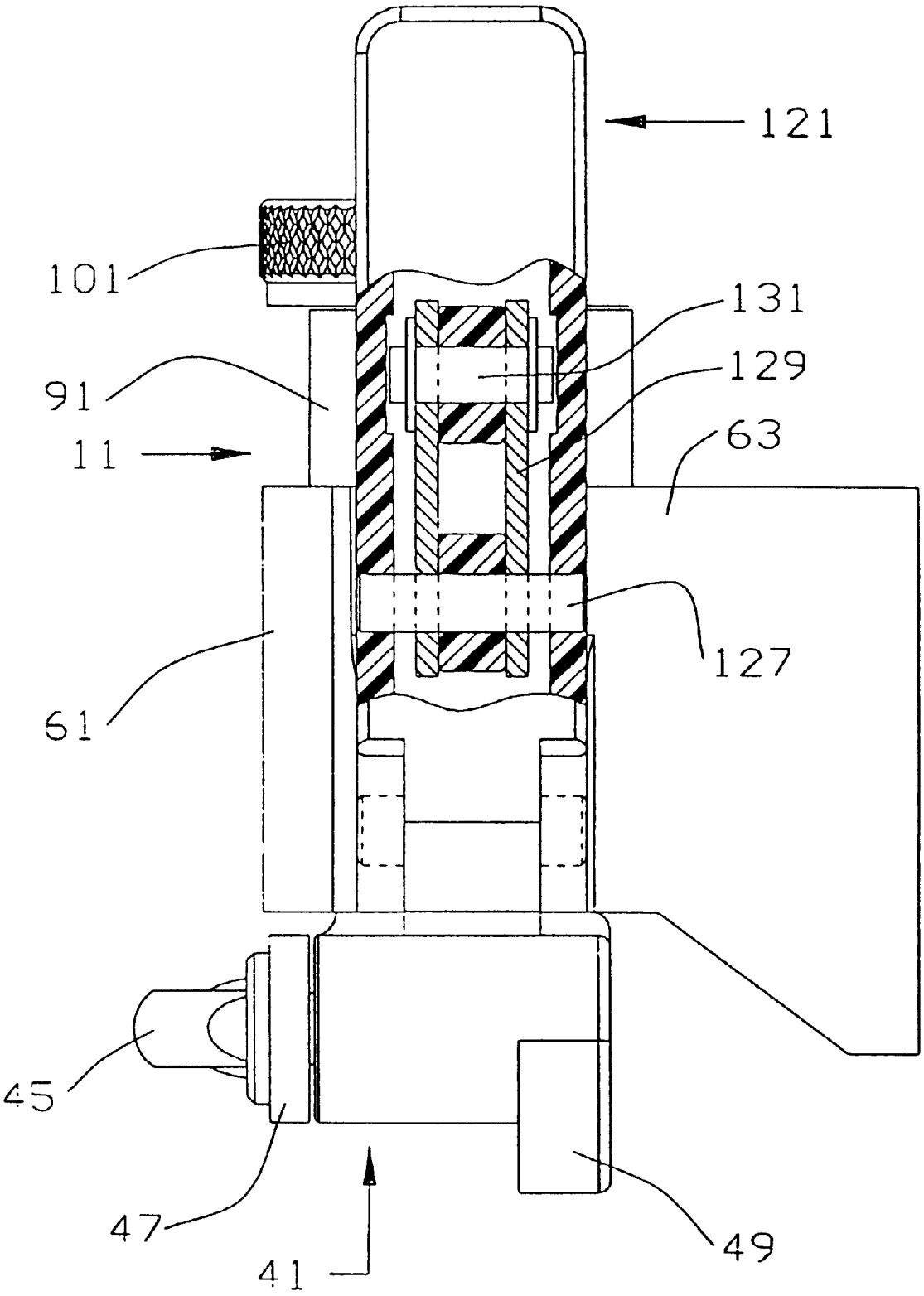
FIG. 4 is a side elevational view of the snare strainer of this invention with parts broken away and others shown in cross section.
Figure 5:
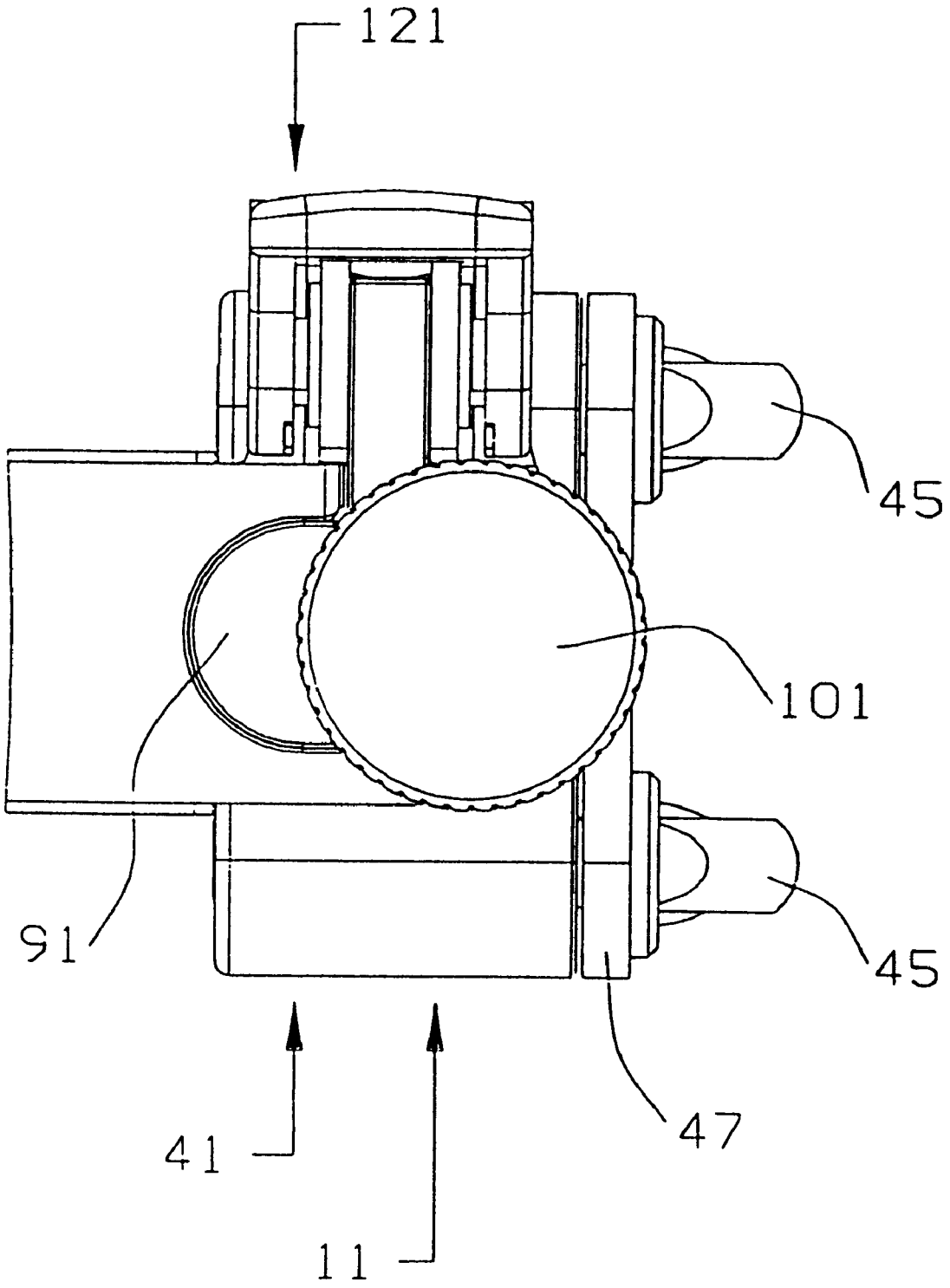
FIG. 5 is a top plan view of the snare strainer of this invention.

FIGS. 1 and 2 of the drawings show the snare strainer 11 of this invention attached to a snare unit 13 mounted on a drum 15. As is conventional, the drum 15 includes a shell 17 with the wires or snares 19 of the snare unit 13 positioned against the bottom drum head 21 of the drum. The drum heads are held in position against the shell 17 by rims 23 at the top and bottom of the shell.

The opposite ends of the snare wires 19 are held by a stationary snare anchor 25 connected by a strap 27 and a shiftable snare anchor 29 connected by a strap 31 with the straps passing through notches 33 in the rim 23. The stationary snare anchor 25 is held by a clamp 35 to a bracket 37 which is fastened to the shell 17 of the drum by fasteners 39. The shiftable snare anchor 29 is connected by its strap 31 to a T-shaped snare clamp 41 which is formed integrally with an elongated stem 43 of non-circular transverse cross section which is similar in shape to the bore of the tubular structure to be hereinafter described. Tuning screws 45 extend through a clamp 47 which holds the strap 31 in position. The strap 31 extends through an undercarriage hanger 49 which prevents the strap from engaging the rim 23 as it passes through the notch 33 in the rim even during throw off of the snare wires 19.

The snare strainer 11 includes a tubular structure 61, shown most clearly in FIGS. 3, 6, 7 and 8 of the drawings, having an integral bracket 63 (FIG. 2) by which it is mounted on the shell 17 of the drum. The tubular structure 61 functions as a cylinder. The bracket 63 has a drum shell engaging wall 65 forming an enclosed passage 67 that is open at its bottom. A generally elliptical non-circular bore 69 extends through the tubular structure. The bore 69 has a first axis 71 and a second axis 73 with rounded ends 75 positioned on the first axis. Although the preferred embodiment of the invention shows a bore with a pair of diametrically located rounded ends, it should be understood and appreciated that the objects of the invention will be substantially achieved if the bore is modified so long as it is a noncircular and has at least one curved bearing surface such as surface 75 of a substantial extent formed as part thereof. By substantial extent, I mean an extent greater in relation to the periphery of the bore than is provided by rounded or chamfered corners of a bore of generally rectangular cross section which would be required to snugly receive a tube having rounded corners of the extent found in conventional rectangular steel tubing.

A vertically extending notch 77 is formed in the wall of the tubular structure 61 adjacent the non-circular bore. (See FIGS. 6 and 7) A threaded fastener 79 (FIG. 2) connects the bracket 63 to the shell 17 of the drum 15 at the upper end of the bracket and a vented threaded fastener 81 (FIGS. 2 and 8) connects the bracket at its lower end to the drum with the vented threaded fastener having an axial vent passage 83 leading from the interior of the drum 15 to the enclosed passage 67 of the bracket.

Figure 6:
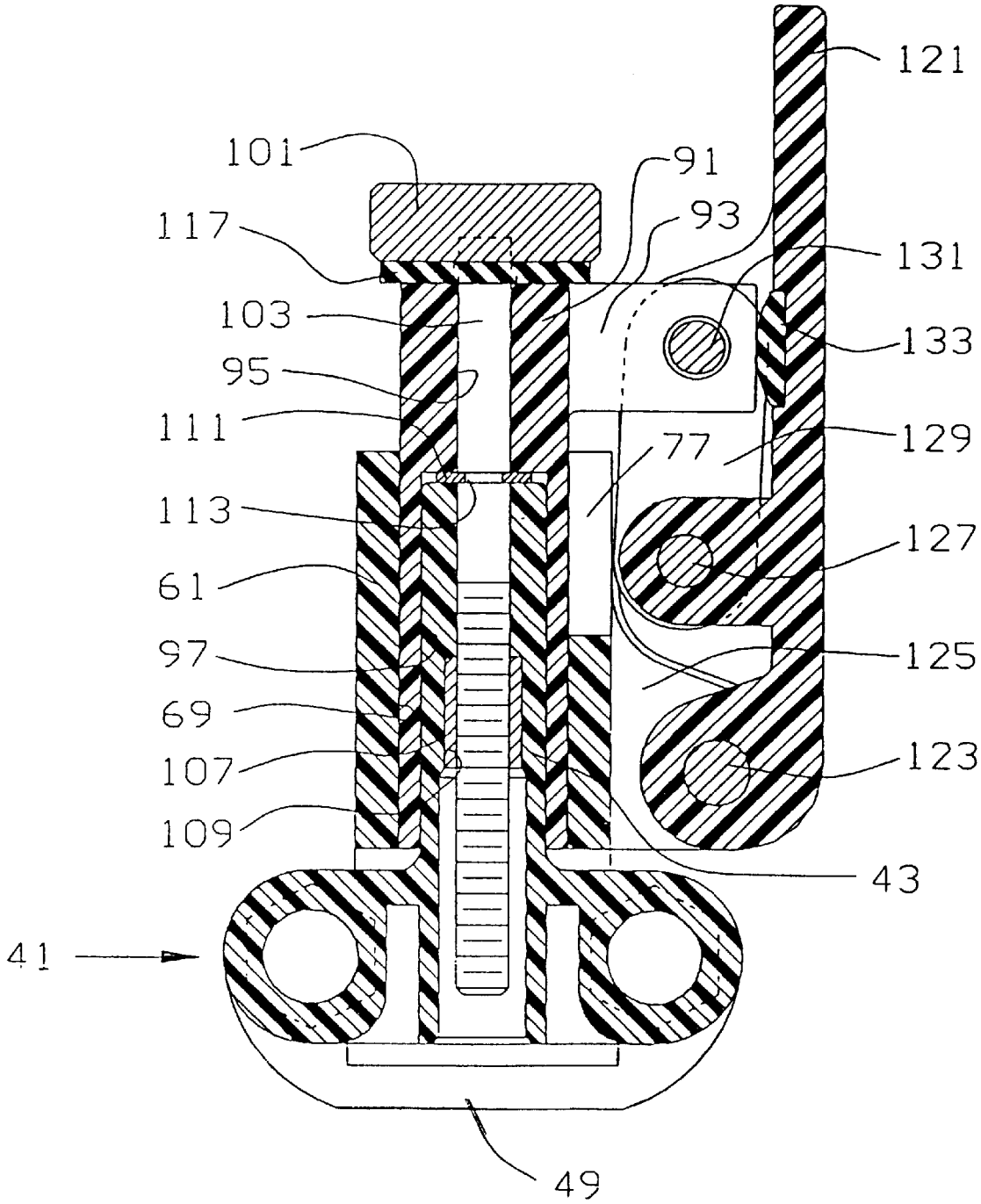
FIG. 6 is a vertical cross section of the snare strainer shown in its snare tension applying position.
Figure 7:
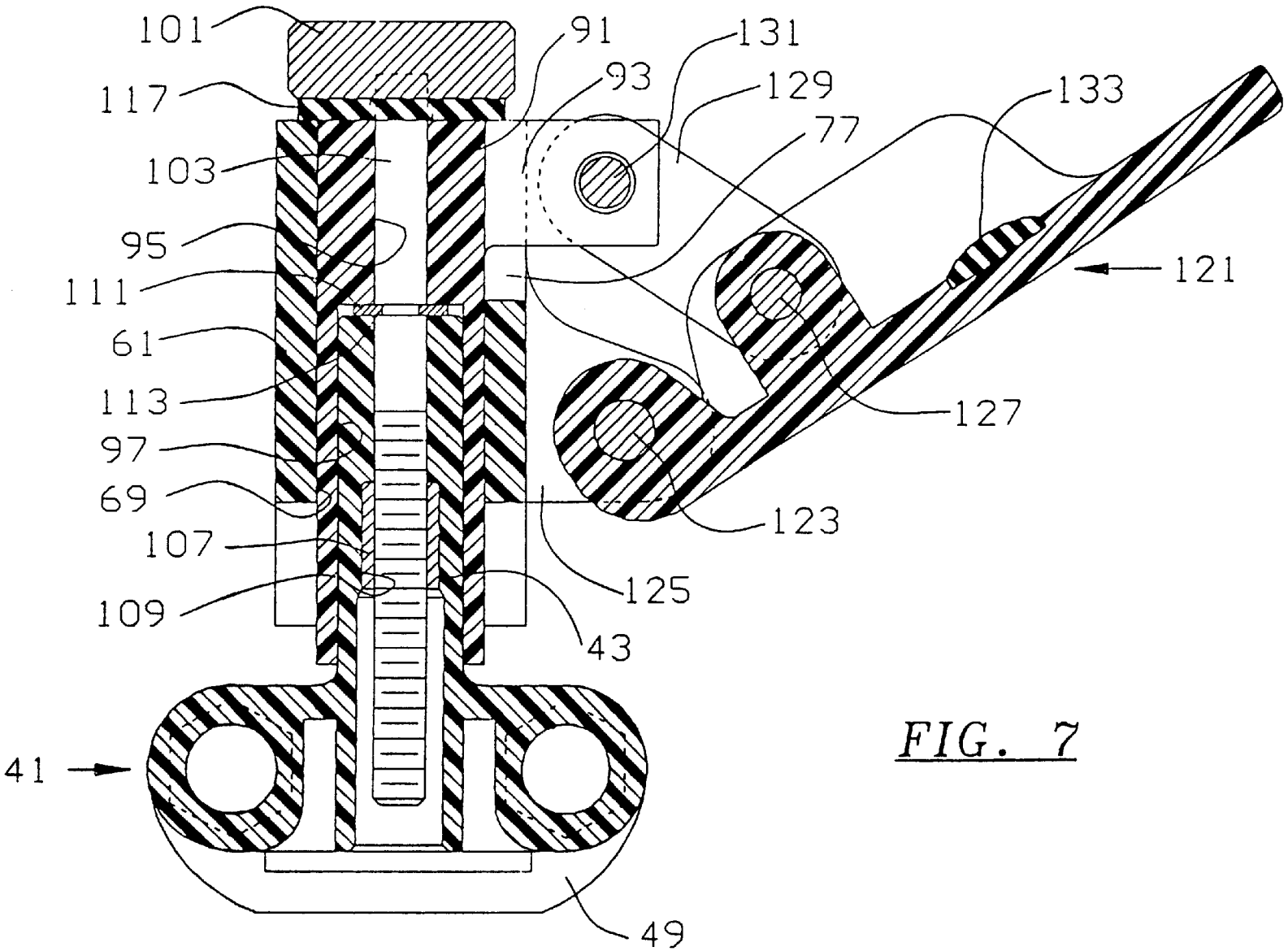
FIG. 7 is a cross sectional view of the snare strainer similar to that of FIG. 6 but shown in its snare tension released position.
Figure 8:
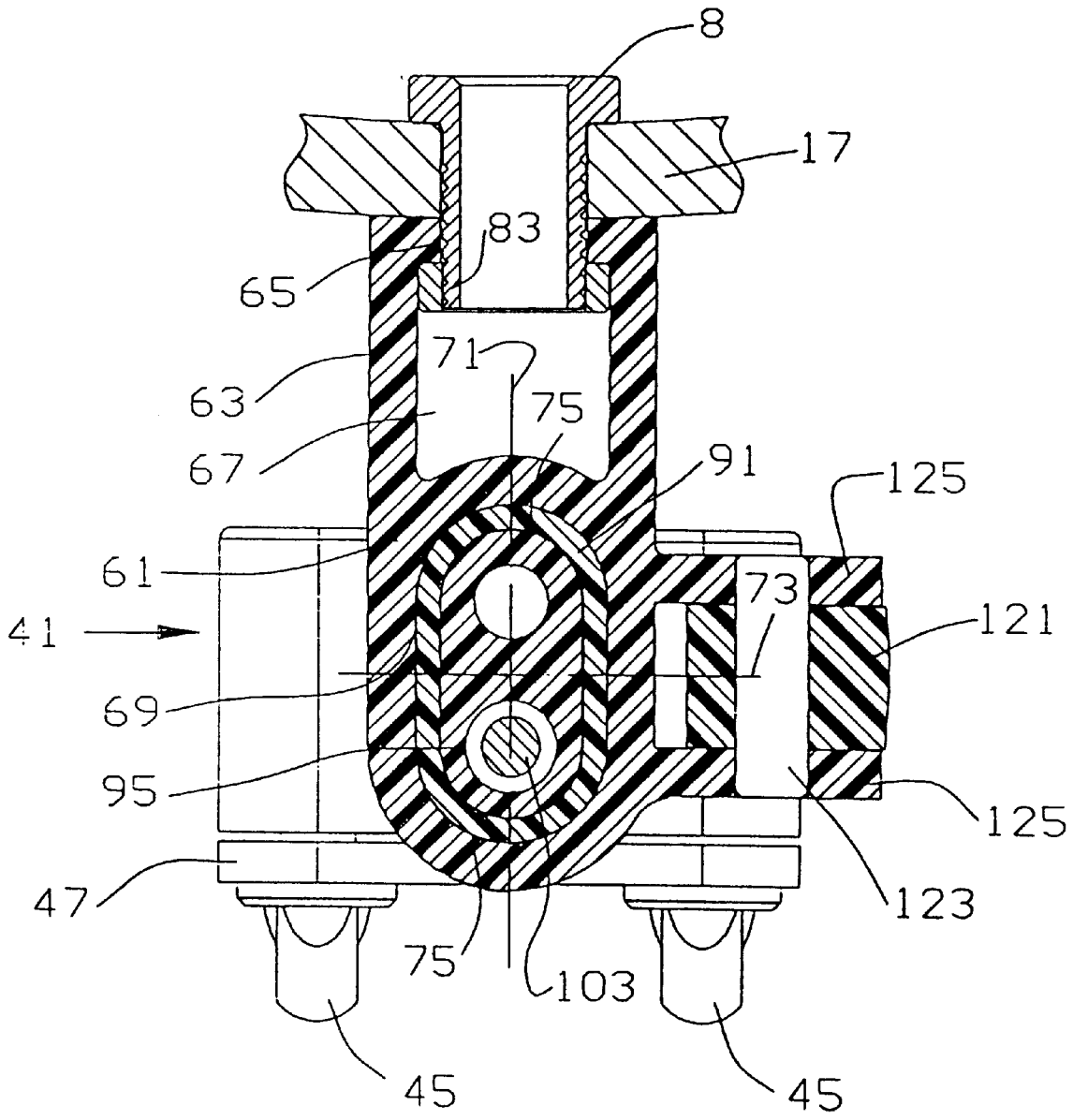
FIG. 8 is an enlarged cross sectional view taken along line 8—8 of FIG. 2.

As shown most clearly in FIGS. 6, 7 and 8 of the drawings, a piston 91 of the same general transverse cross sectional shape as the bore 69 of the tubular structure 61 seats in the bore 69 for vertical movement therein. Accordingly, if the bore is formed with only one curved bearing surface of a substantial extent rather than the oppositely located rounded ends 75, the piston will be formed with a similar cross section. The piston includes an integral arm 93 which slides in the notch 77 in the wall of the tubular structure 61. The piston has a bore 95 which is enlarged at 97 at its lower end. A cylindrical knob 101 is fastened to a threaded rod 103 that extends through the eccentrically located bore 95 in the piston 91 and threadably engages an internally threaded sleeve 107. Sleeve 107 is located in an eccentrically located bore 109 of the elongated stem 43 of the T-shaped snare clamp 41 and fastened to stem 43.

An E-shaped spring clip 111 snaps into an annular groove 113 formed in the threaded rod 103 to limit vertical movement of the threaded rod 103 relative to the piston 91. A washer 117 of a soft material is positioned between the cylindrical knob 101 and the top of the piston 91 to deaden any noises that might be caused by contact between the knob and the tubular structure 61 during throw off of the snares.

An operating handle 121 for applying tension to and releasing tension from the snare bed 13 is pivotally mounted by a pivot pin 123 to a clevis 125 formed integrally with the tubular structure 61. Also carried on the operating handle 121 is a pivot pin 127 which is part of a link assembly 129 attached to the handle. A pivot pin 131 fits in the opposite end of the link assembly 129 and it is pivotally connected to the integral arm 93 of the piston 91. A bumper 133 is located on the handle 121 and engages the integral arm 93 to stop movement of the handle 121. The pivot pins 127 and 131 are positioned closer to the tubular structure 61 than is the pivot pin 123 when the handle 121 is moved to its tension applying position shown most clearly in FIGS. 3 and 6 of the drawings. In this position of the handle 121, the pivot pin 127 which connects the handle and the link assembly 129, is closest to the tubular structure 61 and, thus, is in an overcenter position relative to both the pivot pin 123 and the pivot pin 131. The overcentering of the pivot pins 123 and 131 in the tension applying position of the operating handle 121 prevents accidental release of the handle 121.

Figure 9:
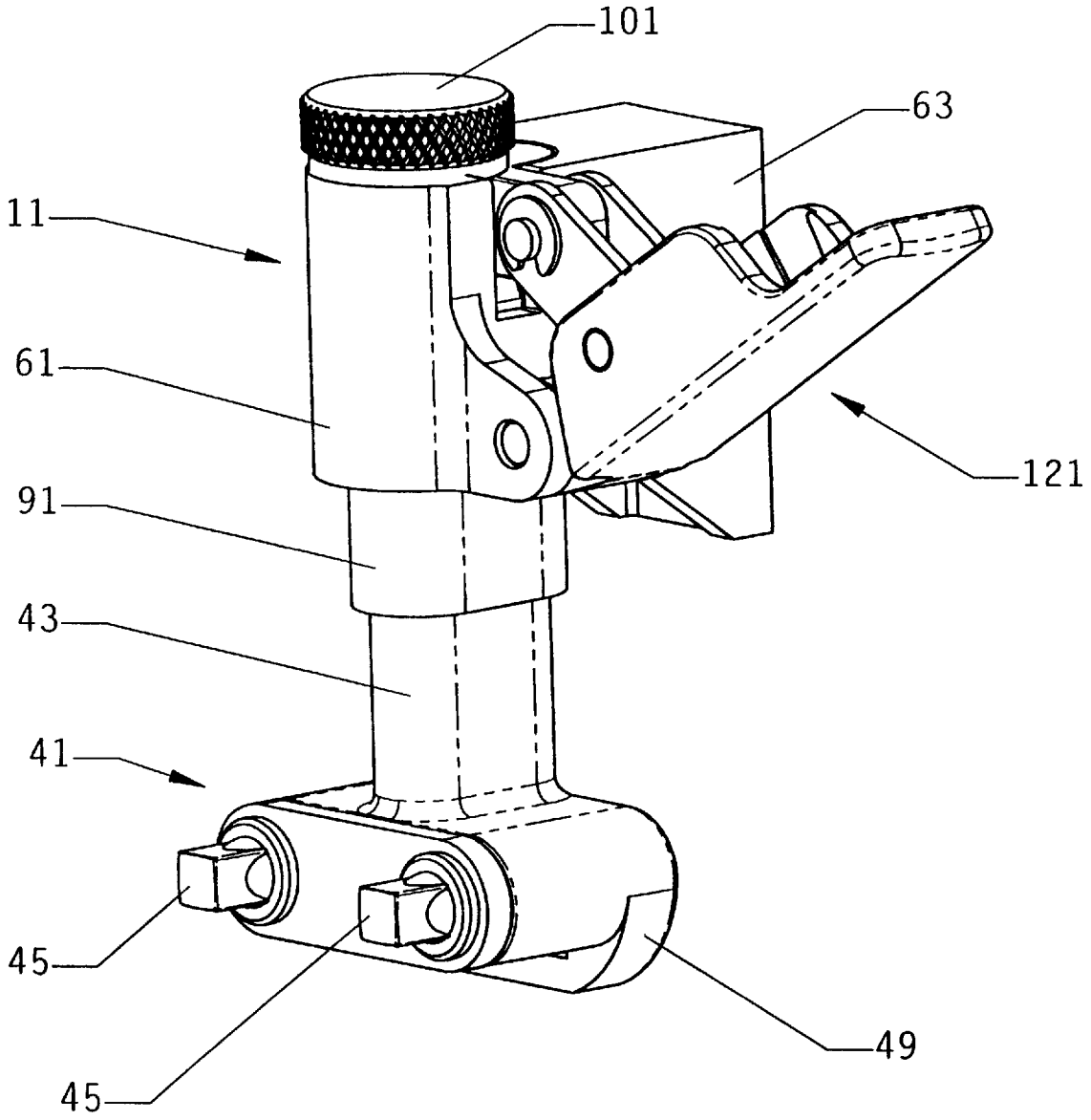
FIG. 9 is a perspective view of the snare strainer of this invention shown in its snare tension released position but detached from a drum and snares.

When the snare wires 19 are in contact with a drumhead 21, as shown FIGS. 1 and 2 of the drawings, the operating handle 121 is in its vertical position, as additionally shown in FIGS. 3, 4, 5, 6 and 8 of the drawings. The piston 91 is at the top of the tubular structure 61 and its arm 93 is located above the notch 77 formed in the tubular structure 61. With the handle in this upright position, the pivot pin 127 is located in an overcenter position relative to the pivot pins 123 and 131 of the operating mechanism. When the handle 121 is rotated in a clockwise direction as viewed in FIGS. 3, 6 and 7 of the drawings to move the snares 19 to their tension release position shown in FIG. 9, the pivot pin 127 of the handle 121 is moved through an overcenter position to move the arm 93 and its piston 91 downwardly through the bore 69 of the tubular structure 61. The piston 91 is forced downwardly to move the elongated stem 43 of the snare clamp 41 in a downward direction as viewed in FIGS. 6 and 7 of the drawings. As the snare clamp is lowered, the undercarriage hanger 49 supports the strap 31 connected to the shiftable snare anchor 29 and prevents the strap from engaging the rim 23 of the drum.

Tension on the snare wires 19 of the snare bed 13 can be adjusted by rotating the cylindrical knob 101 relative to the tubular structure 61. Rotation of the cylindrical knob 101 will rotate the threaded rod 103 so that its threads which mesh with the threaded sleeve 107 in the bore of the stem 43 of the snare clamp 41 will accurately move the snare clamp 41 and the shiftable snare anchor 29 and, thus, adjust the tension of the snares against the snare bed 13.

The design of the non-circular bore 69 of the tubular structure 61 and the corresponding shape of the piston 91 with their first axes 71 and second axes 73 in which the first axes extend at right angles to the plane of movement of the operating handle 121 and its linkage 129 effectively prevents the piston 91 from twisting in the bore 69 during operation of the operating handle, thus reducing both noise and wear. Twisting of the piston relative to the bore would result in excessive wear because of the close tolerances between the piston and the bore. As previously explained, twisting of the piston in the bore is prevented by forming the bore and the piston with similar non-circular cross sections. However, it should be understood that the curved surfaces do not have to be on the first or second axes of the bore. As a matter of fact, the bore does not have to have first and second axes, these being shown only as a preferred embodiment of the invention. The same considerations apply to the transverse cross section of the snare clamp stem 43 in its relationship to the bore 95 of the piston 91. Ease of sliding movement is obtained by providing at least one curved bearing surface in the bore and on the piston with the curved bearing surface having a substantial extent relative to the respective perimeter of the bore and the piston. Prevention of twisting of the piston is not dependent upon any extension of the piston engaging the walls of a slot as in previous snare strainers. For example, the arm 93, which is integral with the piston, does not contact the walls of the tubular structure 61 defining the notch 77. Instead, the non-circular shape of the piston 91 in conjunction with the similar shape of the bore 69 of the tubular structure 61 prevents twisting of the piston while providing large bearing surfaces, one or more rounded ends 75, to distribute the load applied to these parts.

The vented threaded fastener 81 is not visible to observers during normal operation of the drum because its vent passage 83 is hidden by the enclosed passage 67.

I claim:

1. A snares strainer for a snare drum having snares, at least one drumhead and a shell, said snare strainer including:

a tube having a non-cylindrical transverse cross section which includes at least one curved bearing surface of substantial extent, a bracket mounting said tube on the shell of said drum, a piston positioned in said tube for slidable movement between a first position and a second position, said piston having a transverse cross section similar in shape to said transverse cross section of said tube, a snare tensioning rod affixed to said piston and to a snare clamp, said snare clamp affixed to said snares to locate said snare against said drumhead when said piston is in said first position and to locate said snares away from said drumhead when said piston is in said second position, and a quick release mechanism mounted on said tube and connected to said piston for moving said piston between said first and second positions, said quick release mechanism including a handle pivotally mounted on said tube and a linkage connected to said piston, said handle and said linkage mounted for rotational movement during movement of said piston between first and second positions.

2. The snare strainer of claim 1 in which said non-cylindrical transverse cross section is formed with a first axis and a second axis with said curved bearing surface positioned on said first axis.

3. The snare strainer of claim 1 in which said non-cylindrical transverse cross section includes a first axis and a second axis with oppositely located curved bearing surfaces positioned on said first axis.

4. The snare strainer of claim 1 in which said bracket is attached to said shell by at least one fastener and an axial passage is formed in said fastener to allow air flow into and out of said drum.

5. The snare strainer of claim 1 in which a drum rim surrounds said drumhead, said snare tensioning rod is affixed to said snares by a slidable strap attached to said snare clamp, said strap extends through an opening in said drum rim and a hanger is attached to said snare clamp to receive and guide said strap during movement of said piston between said first and second positions.

6. The snare strainer of claim 1 in which said piston has a bore with a transverse cross section similar in shape to said non-cylindrical transverse cross section of said piston, a snare clamp stem having a transverse cross section similar in shape to said non-cylindrical transverse cross section of said piston received on said piston bore and said snare clamp stem being adjustably connected to said snare tensioning rod.

7. A snare strainer for a snare drum having snares, at least one drumhead and a shell, said snare strainer including:

a tube having a bracket for mounting said tube to sail shell, a piston installed in said lust for slidable movement between a first position and a second position, a snare tensioning rod affixed to said piston and to a snare clamp, said snare clamp affixed to said snares to locate said snares against said drumhead when said piston is in said first position and to locate said snares away from said drumhead when said piston is in said second position, a quick release mechanism mounted on said tube and connected to said piston for moving said piston between said first and second positions, at least one fastener attaching said bracket to said drum, and an axial passage formed in said fastener to allow air flow into and out of said drum.

* * * * *